United States Patent [19]

Ballu

[11] Patent Number: 4,872,467

[45] Date of Patent: Oct. 10, 1989

[54] DEVICE FOR RINSING CONTAINERS

[75] Inventor: Patrick Ballu, Reims, France

[73] Assignee: Tecnoma, Epernay, France

[21] Appl. No.: 272,927

[22] Filed: Nov. 18, 1988

[30] Foreign Application Priority Data

Nov. 30, 1987 [FR] France ..... 87 16561

[51] Int. Cl.[4] ..... B08B 3/02; B08B 9/08

[52] U.S. Cl. ..... 134/104.2; 134/166 R

[58] Field of Search ..... 134/104.2, 104.4, 166 R, 134/167 R, 168 R, 169 R

[56] References Cited

U.S. PATENT DOCUMENTS

| | | | |
|---|---|---|---|
| 173,422 | 2/1876 | Schock | 134/167 R X |
| 1,730,658 | 10/1929 | Jensen | 134/168 R |
| 1,783,776 | 12/1930 | Boeschel | 134/168 R X |
| 1,841,505 | 1/1932 | Sweetland | 134/167 R X |
| 2,385,393 | 9/1945 | Wilson | 134/104.4 X |
| 3,564,584 | 2/1971 | Ruddick | 134/166 R |

FOREIGN PATENT DOCUMENTS

| | | |
|---|---|---|
| 504436 | 10/1979 | Australia . |
| 61436 | 7/1891 | Fed. Rep. of Germany . |

*Primary Examiner*—Philip R. Coe

*Attorney, Agent, or Firm*—Watson, Cole, Grindle & Watson

[57] ABSTRACT

The invention relates to a device for the rinsing of containers, particularly small-size containers of plant-protective or toxic products.

The same assembly comprises a rinsing liquid inlet, a channel directed upwards which can penetrate into the container to be rinsed, introduced with the opening downwards, and an ejector fed by a branch from the rinsing liquid supply and capable of removing the draining liquid collected in a funnel surrounding the channel. Preferably, the positioning of the container controls, via a pushing device, the supply of liquid to the channel.

8 Claims, 3 Drawing Sheets

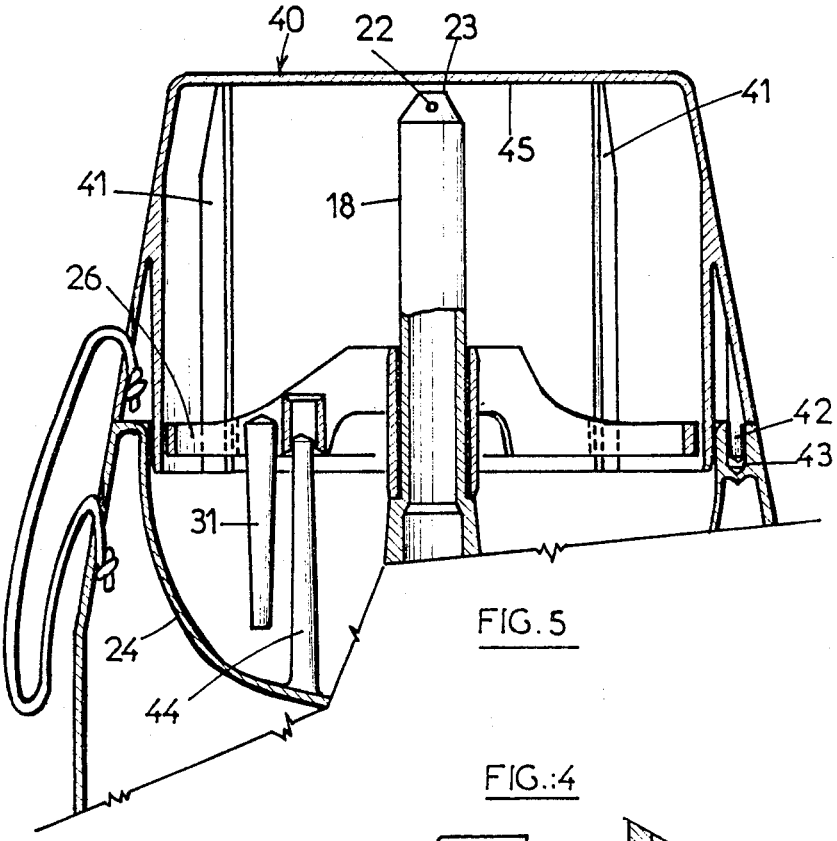
FIG. 5
FIG.:4
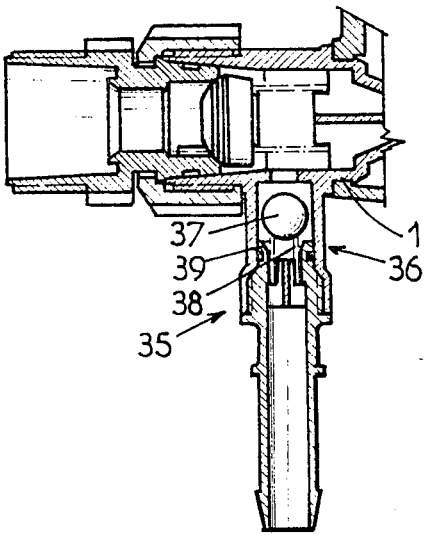

DEVICE FOR RINSING CONTAINERS

BACKGROUND OF THE INVENTION

The present invention relates to a device for rinsing containers containing, for example, plantprotective or toxic products.

Requirements of safety and of protection of the environment have made it necessary, with increasing acuteness, to pay attention to the removal of waste and, in particular, of empty packaging. Moreover, agriculture uses increasing quantities of plant-protective products which are generally presented in packaging of small capacity, in a very concentrated form, and which have to be diluted at the time of use. The containers of concentrated products, once empty, pose a problem of removal. In the case of rigid containers, generally made from plastic, which have contained these products, it is necessary to carry out a careful rinsing before their destruction by fire, their storage with a view to salvage or their burial in the ground at suitable sites.

On a farm, the quantity of containers to be rinsed may be considerable at the end of an operation. The usual means used are very time-consuming, impractical and often do not permit recovery or recycling of rinsing waters, either for their neutralization or for their mixing with treatment liquids where this is possible.

There is therefore a need for a device which makes it possible to rinse completely, rapidly and even immediately and without excessive handling work, a series of drums which have contained a concentrated product.

The aim of the invention is to provide an apparatus which makes it possible, without fatigue and in a short time, to carry out the rinsing, in batches or progressively, of a considerable number of small-sized containers, the rinsing being carried out effectively and completely and the rinsing waters being easily collected, preferably in order to be incorporated immediately into a slurry which has just been prepared in the vessel of an atomizer.

SUMMARY OF THE INVENTION

In order to obtain this result, the invention supplies a device for rinsing containers comprising a pressurized rinsing liquid inlet, a channel provided with at least one nozzle capable of spraying the rinsing liquid toward the inner walls of the container, means for collecting the polluted liquid outside the container, and means for removing it towards a device for storage, treatment or use, with the particular feature that the same one-piece assembly comprises:

the rinsing liquid inlet, the channel with its nozzle mounted at the end of a conduit capable of penetrating into the container via an orifice of said container, a funnel capable of collecting the polluted liquid escaping via said orifice, and a polluted liquid ejector fed via a branch from the rinsing liquid supply, whose inlet is connected to said funnel and whose outlet is connected to the removal means.

"One-piece assembly" is understood to mean either a single piece, obtained by moulding, for example, or alternatively a rigid assembly of several pieces connected via screwing or welding, for example, and whose relative arrangement does not vary during use.

Preferably the device according to the invention comprises a valve arranged in order to stop the supply of rinsing liquid to the channel whilst maintaining the supply to the ejector.

In this case, provision is advantageously made for said valve to comprise a piece capable of sliding along the axis of the channel between a closure position, towards which it is pushed by a spring, and an opening position, into which it may be brought by the displacement of a pushing device coaxial to the channel and capable of being actuated, in opposition to said spring, by the container itself or the part of the wall of the latter which extends around the orifice in which the channel is introduced.

According to an advantageous embodiment, the pushing device may be mounted in at least two different positions with respect to the channel in order to adapt the device to different containers. Preferably, passage from one position of the pushing device to another is effected by turning it from top to bottom.

According to another advantageous embodiment, the device is equipped with a cover covering the funnel in order to protect it when not in use, this cover being capable of causing the channel to pass into an opening position for cleaning the inner face of said cover, either by action of the cover on the pushing device or by the action of the bottom of the cover on the channel itself.

According to yet another advantageous embodiment, the deivce is equipped with a drain equipped with a flap value which closes when the rinsing liquid is admitted under pressure into the device and which opens when this pressurized liquid is no longer admitted and the cross section of the drain, when the flap valve is open, is greater than the cross section of the passage offered to the liquid travelling from the funnel towards the ejector.

Advantageously, the device is connected to means for filling an apparatus for scattering or spraying a solution for treating soils or plants, in order to enable the polluted rinsing liquid to be mixed with this solution.

BRIEF DESCRIPTION OF THE DRAWINGS

The invention will now be explained in a more detailed manner with the aid of a practical example illustrated by the drawings, in which:

FIGS. 4 and 5 are partial views similar to that of FIG. 1 and relate to the drain and to the cover, respectively.

DESCRIPTION OF A PREFERRED EMBODIMENT OF THE INVENTION

Figure 1:
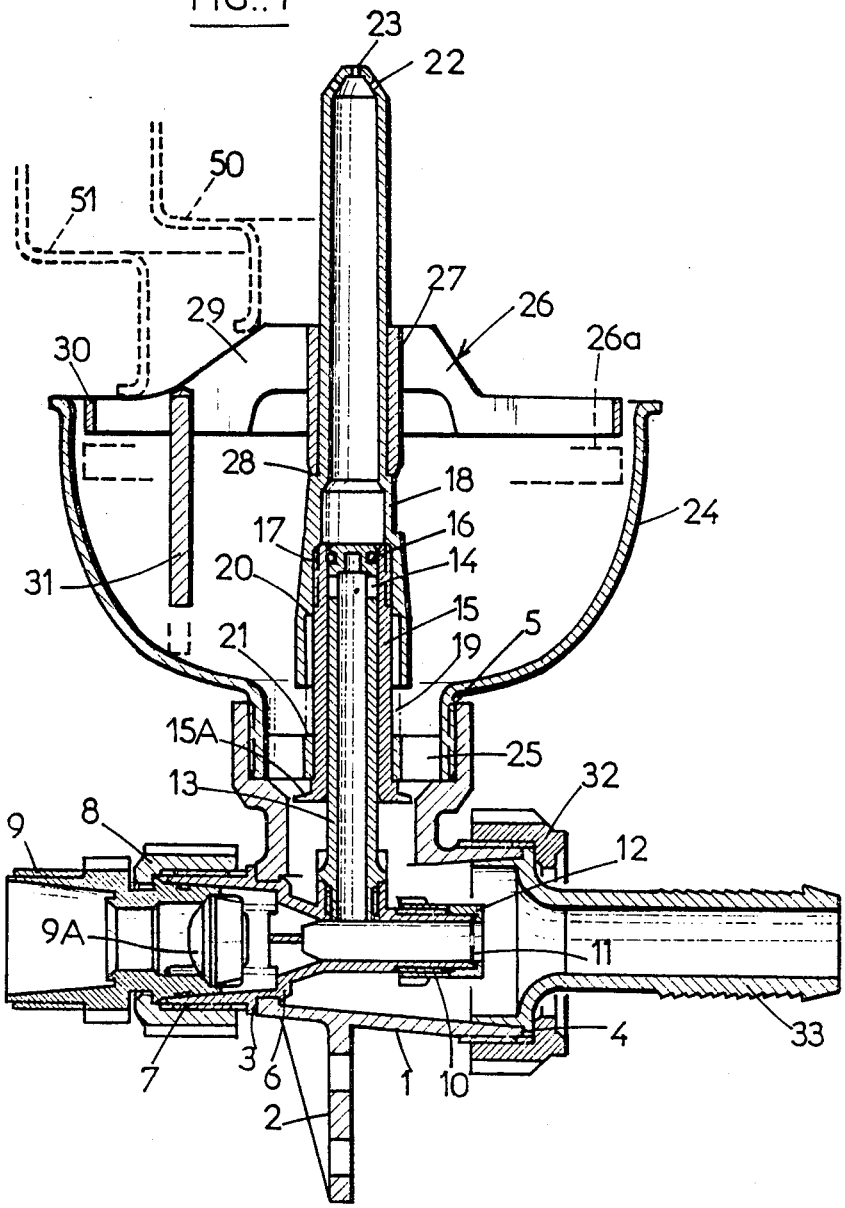
FIG. 1 is a longitudinal section of a device as defined by the invention, described by way of example.

The device as defined by the invention, described here as a non-limiting example, is intended for the rinsing with water of containers currently on the market with a capacity of between 0.5 and 20 liters approximately.

A casing 1 is provided with a fixing lug 2 in order to connect it to a support, which is not shown. The casing comprises an inlet orifice 3, with a horizontal axis, a removal orifice 4, coaxial to the inlet orifice, and a vertical orifice 5 for connecting with the container. A distributor 6, force-fitting in the inlet orifice 3 is mounted inside the casing and it has a tubular part 7 which projects outside the inlet orifice of the casing, has an outside thread, and carries a threaded ring 8 which holds a joining piece 9 with a water supply conduit, which is not shown. A nonreturn valve 9A is inserted between the distributor 6 and the joining piece 9.

The distributor 6 also comprises a tubular part 10 located as an extension of the inlet orifice and which leads to a diaphragm 11, forming a throat, held in place by a threaded part 12.

Moreover, the distributor comprises a vertical tubular piece 13 which opens into the tubular part 10 and is coaxial with the connecting orifice 5. The end of the tubular piece 13, which is opposite the distributor 6 is closed and has horizontal passages 14. A sleeve 15 can slide along the tubular piece 13 between a hh position, where it closes the passages 14, and a low position, which is not shown, in which these passages are open. When the sleeve 15 is in a high position, the seal is obtained via O-rings placed in the throats of the tubular piece 13, above the passages 14. The sleeve 15 is connected to the channel 18 by means of a thread 17. The channel 18 is a tubular piece with an internal diameter greater than the internal diameter of the sleeve 15, at least over a certain part of its length. A compression spring 19 bears, on the one hand, on a shoulder 20 of the channel and, on the other hand, on a ring 21 which is fixed with respect to the casing 1. This spring therefore tends to hold the channel and the sleeve 15 in a high position, that is to say with the passages 14 blocked. In the upper part, the channel ends in nozzles 22 directed obliquely and a nozzle 23 which is axial. A funnel 24 for receiving draining liquid is mounted coaxially to the channel. In its lower part, it bears on the edges of the joining orifice 5 of the casing and it is connected at this point to the ring 21 via spacers 25.

Figure 3:
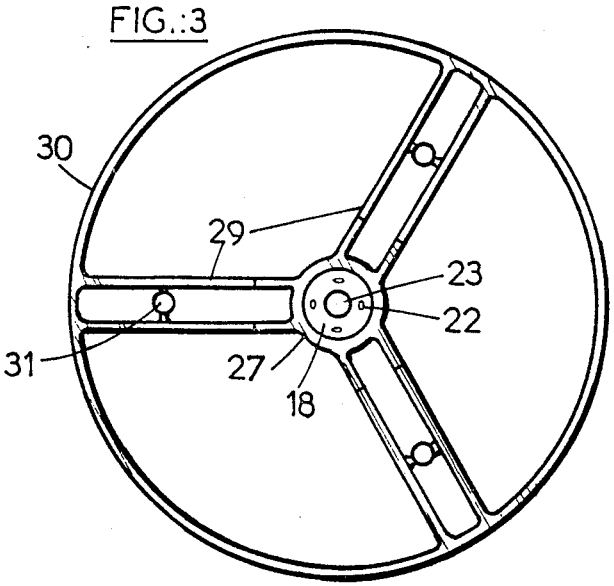
FIG. 3 is a view of the pushing device taken along the axis of the channel.

A pushing device 26, whose plane aspect indicated in FIG. 3 is that of a three-branched flywheel, comprises a sleeve 27 which can slide along the channel and is stopped by the latter by virtue of a shoulder 28, and three radial branches 29 connected at their ends via a ring 30 with a diameter less than the maximum diameter of the funnel 24. Each of these radial branches 29 carries a peg 31 whose use will be seen below. The number of branches 29 may be other than three.

The removal orifice 4 of the casing holds, by virtue of a threaded ring 32, a venturi 33 provided with means for joining to a removal conduit which is not shown. The inner cross section of the venturi 33 is calculated in order to form, interacting with a jet emerging from the orifice of the diaphragm 1, a removal device capable of evacuating the draining liquid which has descended from the funnel 24 to the inside of the casing 1.

FIG. 4 shows an alternative embodiment of the device of FIG. 1. The difference consists in the fact that the casing 1 is provided with a drain 35 provided with a flap valve 36 with a ball 37. A calibrated spring 38 raises the ball 37 on its seating 39 when the casing is subjected to a low pressure. However, when the device is subjected to the use pressure of the rinsing liquid, the flap valve is closed. Moreover, the sleeve 15 comprises a toothed peripheral projection 15A (Figure 1) which narrows the passage between the bottom of the funnel 24 and the removal orifice 4 of the casing. The use of the drain and of the throat will be explained below.

FIG. 5 shows another embodiment of the device. A cover 40, in the form of an inverted bowl, may be placed on the edges of the funnel 24 in order to protect it when not in use. The cover comprises inner axial ribs 41, two of which are shown. On its edge, the cover has one (or several) axial stubs 42 which penetrate either in a hole 43 provided on the edge of the funnel or in another hole on the same edge angularly offset in a suitable manner. When the cover is placed on the funnel with the stub 42 in the hole 43, the ribs 41 are out of contact with the pushing device 26 whereas, if the stub is in the other hole, the ribs 41 bear on the pushing device and therefore control the opening of the channel for the internal cleaning of the cover. A peg 44 which is an integral part of the funnel immobilizes the pushing device in rotation.

In a simpler alternative embodiment, but one which is less robust, the bottom of the cover is flexible and its shape is calculated so that, at rest, the cover rest on the funnel with the channel 18 flush with the bottom 45 of the cover or at a small distance from it. By bearing on the bottom of the cover, the channel is moved and is brought into an opening position. The rinsing liquid then passes essentially via the lateral nozzles 22, the axial nozzle 23 being obstructed.

The device operates as follows:

Firstly, the rinsing liquid, in principle water, is supplied at a suitable pressure into the inlet orifice, the passages 14 being closed. The rinsing liquid then flows through the orifice of the diaphragm 11 and the venturi 33 directly towards the removal device. A container to be rinsed is then put into position and, in order to rinse it, it is turned, with its opening downwards, and it is placed in a manner such that the channel penetrates inside via this opening. The container is then pushed downwards until it bears against the branches 29 of the pushing device (see FIGS. 1 and 2).

A continuation of the movement of the container downwards drives the pushing device and the channel 18 against the force of the spring 19 until the passages 14 are open. The rinsing liquid then penetrates inside the channel and is sprayed by the nozzle 22, 23. When it is considered that the container is sufficiently rinsed, it is removed, which stops the flow from the channel, the rinsing liquid continuing to pass via the orifice of the diaphragm 11. By the action of the ejector formed by this orifice and the venturi 33, all the liquid collected in the funnel 24 is quickly removed and the assembly is rinsed and emptied.

It is therefore possible to interrupt the supply of pressurized rinsing liquid via the inlet orifice 3. Let us suppose that the polluted liquid is forced back via the removal orifice 4 to a level greater than that of the device; the stopping of the supply of rinsing liquid will result in the polluted liquid turning back. It is in order to avoid this liquid remaining in the device that the arrangement which is the subject of FIG. 4 has been provided. The pressure drop inside the casing 1 causes the opening of the flap valve 36 of the drain 35 and the removal of the returning liquid. As the cross section of the passage in the direction of the funnel is smaller than that of the drain, the returning liquid does not flow back into the funnel.

If the polluted liquid is forced back to a lower level, the drain is not necessary. It may be removed and replaced by a plug.

As has been observed, the arms 29 of the pushing device have a shape which is inclined towards the periphery. The result of this is that the larger the orifice of the container, the more deeply the channel penetrates inside it, which is favourable since the largest containers are generally those with the largest orifice.

In FIG. 1, a part of the section of a rigid container with a narrow neck 50 has been shown in dotted lines, resting on the central region of the pushing device 26. In the same figure, also in dotted lines, a part of the section of a rigid container with a wide neck 51 has also been shown, resting on the peripheral region of the pushing device 26.

Figure 2:
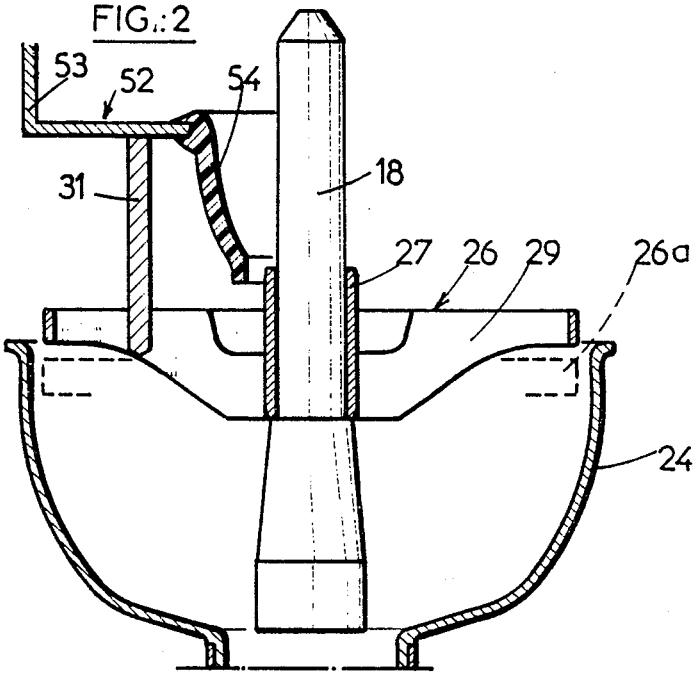
FIG. 2 is a partial view similar to that of FIG. 1 and showing a different arrangement.

If it is desired to rinse short containers, or containers whose neck is flexible or retractable, it is possible to turn the pushing device 26 upside down so that it assumes the position indicated in FIG. 2. In this position, the pegs 31 are directed upwards.

If necessary, it is possible to provide a larger number of positions for the pushing device 26, for example with staggered stops carried by the channel.

On this FIG. 2, a part of the section of a container 52 formed from a rigid body 53 provided with a flexbile neck 54 has been represented. As may be seen, the pegs 31 come into contact with the rigid body 53 and the flexible neck 54 does not touch the pushing device. There is therefore no risk of damaging this neck or of retracting it inside, which leads to incomplete rinsing. The penetration of the channel into the container is also limited by the action of the pegs, which prevents it colliding with the bottom of the container.

In FIGS. 1 and 2, the position of the pushing device when puhed down as far as possible has been shown diagrammatically in dotted lines at 26A.

As may be seen, the device of the invention permits extremely rapid washing operations for a large number of containers; these operations are limited to turning the container and to positioning it on the channel, then to withdrawing it after rinsing. It is then possible to close the container which contains only a few drops of clean water. If necessary, the cover 40 is also placed on the funnel 24 and, if appropriate, it is rinsed in the manner indicated above. This results in an appreciable saving of time on the preparation "site" whilst still obtaining cleaning of an excellent quality and without polution of the environment.

In a preferred arrangement, the device described in series connected or branch connected to the supply conduit of the filling device of a sprayer. The rinsing waters are therefore immediately incorporated to the slurry contained in the sprayer and which has been prepared with the concentrated product which was contained in the containers which are to be rinsed. In this way, total use of the product is ensured at the same time as the removal of any rinsing water storage or treatment problem.

I claim:

1. A device for rinsing containers in which a onepiece assembly comprising:

inlet means for a pressurized rinsing liquid, a channel connected to said inlet means and provided with a nozzle located at the end of a conduit capable of penetrating in said container via an orifice of said container and capable of spraying rinsing liquid towards the inner walls of the container, a funnel capable of collecting the polluted liquid escaping from the container via said orifice, and a polluted liquid ejector fed via a branch from the rinsing liquid supply, having an inlet connected to said funnel and an outlet for the polluted liquid mixed with the fraction of rinsing liquid which supplies said ejector.

2. The device as claimed in claim 1, comprising, in addition, a valve arranged in order to stop the supply of rinsing liquid to the channel whilst maintaining the supply to the ejector.

3. The device as claimed in claim 2, in which said valve comprises a piece capable of sliding along the axis of the channel between a closure position, towards which it is pushed by a spring, and an opening position, into which it may be brought by the displacement of a pushing device coaxial to the channel and capable of being actuated, in opposition to said spring, via the container itself or the part of the wall of the latter which extends around the orifice in which the channel is introduced.

4. The device according to claim 3, in which the pushing device may be mounted in at least two different positions with respect to then channel in order to adapt the device to different containers.

5. The device as claimed in claim 4, in which the pushing device passes from one position to another by being turned upside down.

6. The device as claimed in claim 3, comprising, in addition, a cover covering the funnel in order to protect it when not in use, this cover being capable of causing the channel to pass into an opening position for cleaning the inner face of said cover either by the action of the cover towards said pushing device or by the action of the bottom of the cover on the channel itself.

7. The device as claimed in claim 1, comprising, in addition, a drain equipped with a flap valve which closes when the rinsing liquid is admitted under pressure into the device and which opens when this pressurized liquid is no longer admitted, and the cross section of the drain, when the flap valve is open, is greater than the cross section of the passage offered to the liquid travelling from the funnel towards the ejector.

8. The device as claimed in claim 1, in which the outlet of the ejector is connected to the filling means of an apparatus for scattering or spraying a solution for treating soils or plants in order to permit the mixing of the polluted rinsing liquid with this solution.

* * * * *